US006219079B1

(12) United States Patent
Shimizu

(10) Patent No.: US 6,219,079 B1
(45) Date of Patent: Apr. 17, 2001

(54) THIN-FILM THERMAL HEAD INCORPORATING CONDUCTIVE LAYER CONTAINING CU-AG ALLOY

(75) Inventor: Osamu Shimizu, Shizuoka (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 09/518,371

(22) Filed: Mar. 3, 2000

(30) Foreign Application Priority Data

Mar. 4, 1999 (JP) ..... 11-57292

(51) Int. Cl.[7] ..... B41J 2/335
(52) U.S. Cl. ..... 347/208
(58) Field of Search ..... 347/200, 208, 347/206

(56) References Cited

U.S. PATENT DOCUMENTS 5,709,958 * 1/1998 Toyoda et al. ..... 428/620
6,001,461 * 12/1999 Toyoda et al. ..... 428/210

FOREIGN PATENT DOCUMENTS 4-238043 * 8/1992 (JP) ..... 347/208

* cited by examiner

*Primary Examiner*—Huan Tran
(74) *Attorney, Agent, or Firm*—Sughrue, Mion, Zinn, Macpeak & Seas, PLLC

(57) ABSTRACT

A thin-film thermal head incorporating a resistance heating layer; and a conductor layer, wherein the main component of the conductor layer is a Cu—Ag alloy. More particularly, the conductor layer contains Cu by 50 atom % or higher, Ag by 0.5 atom % or higher and 50 atom % or lower and other elements by 2 atom % or lower.

3 Claims, 3 Drawing Sheets

FIG. 1

| % | Cu | Ag | Si | Ni | Al | YIELD ( % ) | RESIS – TANCE | EVALUA – TION |
|---|---|---|---|---|---|---|---|---|
| EX. 1 | 99.5 | 0.5 | 0 | 0 | 0 | 65 | OK | OK |
| CMP. 1 | 100 | 0 | 0 | 0 | 0 | 55 | OK | NG |
| CMP. 2 | 0 | 0 | 0 | 0 | 100 | 45 | OK | NG |
| EX. 2 | 94.2 | 5.8 | 0 | 0 | 0 | 90 OR HIGHER | OK | OK |
| EX. 3 | 88.7 | 11.3 | 0 | 0 | 0 | 90 OR HIGHER | OK | OK |
| EX. 4 | 71.4 | 28.6 | 0 | 0 | 0 | 90 OR HIGHER | OK | OK |
| EX. 5 | 50.2 | 49.8 | 0 | 0 | 0 | 90 OR HIGHER | OK | OK |
| CMP. 3 | 94.5 | 0 | 5.5 | 0 | 0 | 90 OR HIGHER | NG | NG |
| EX. 6 | 90.5 | 9.3 | 0.2 | 0 | 0 | 90 OR HIGHER | OK | OK |
| EX. 7 | 87.8 | 10.3 | 0.3 | 1.6 | 0 | 90 OR HIGHER | OK | OK |

EX : EXAMPLE
CMP : COMPARATIVE EXAMPLE
OK : SATISFACTORY
NG : UNSATISFACTORY

THIN-FILM THERMAL HEAD INCORPORATING CONDUCTIVE LAYER CONTAINING CU-AG ALLOY

BACKGROUND OF THE INVENTION

1. Field of the Invention

The present invention relates to a thin-film thermal head for use in a thermal recording operation, and more particularly to improvement in a thin-film thermal head incorporating a resistance heating layer and a conductive layer.

2. Description of the Related Art

A thin-film thermal head 1 which is a subject of the conventional technique and the present invention, as shown in FIG. 2, incorporates graze projections 2 formed in a line facing the central axis 0 of rotation of a platen 3. When a recording material 4 has been inserted into a space between a platen 3 and the graze projections 2, the graze projections 2 corresponding to an image, which must be printed, are selectively heated. Thus, the image is, through a toner ribbon 5, thermally transferred to the image receiving surface of the recording material 4.

FIG. 3 is an enlarged cross sectional view showing a portion in the vicinity of the graze projection 2 shown in FIG. 2.

As shown in FIG. 3, the graze projection 2 incorporates a projecting graze layer 22 formed on a ceramic substrate 21. Moreover, a resistance heating member 23, a conductor layer 24 and a protective layer 25 are laminated on the graze layer 22. The conductor layer 24 is sectioned at the top surface of the graze layer 22 such that the two sections are formed away from each other for distance A so that a pair of electrodes is formed. When an electric current is supplied to a space between the conductor layers 24 which are the pair of electrodes, the resistance heating member 23 generates heat. The graze projection 2 is structured to cause the resistance heating member 23 between the conductor layers 24 to generate heat to record an image on the recording material 4.

The conventional thin-film thermal head has the structure that the conductor layer 24 is made of aluminum (Al). However, Al having somewhat high resistance suffers from a problem because a conductor layer having low resistance is required so as to be adapted to a thin-film thermal head having a resolution higher than 600 dpi because the recording density has been raised in recent years.

As an element having resistance lower than that of AL, Cu is a known element. When a conductor layer is constituted by using only Cu, the density can be raised because Cu has low resistance. The conductor layer made of only Cu, however, raises a problem in that separation of the film frequently occurs when, for example, the temperature is high. Thus, manufacturing yield deteriorates.

SUMMARY OF THE INVENTION

In view of the foregoing, an object of the present invention is to provide a thin-film thermal head which is capable of simultaneously lowering the resistance and raising the manufacturing yield.

To achieve the above-mentioned object, according to a first aspect of the present invention, there is provided a thin-film thermal head comprising a resistance heating layer and a conductor layer, wherein the main component of the conductor layer is a Cu—Ag alloy.

According to a second aspect of the present invention, there is provided a thin-film thermal head having a structure according to the first aspect, wherein the conductor layer contains Cu by 50 atom % or higher, Ag by 0.5 atom % or higher and 50 atom % or lower and other elements by 2 atom % or lower.

According to a third aspect of the present invention, there is provided a thin-film thermal head having a structure according to the first aspect or the second aspect, wherein pitches of heating elements are 43 $\mu$m or shorter.

Other objects, features and advantages of the invention will be evident from the following detailed description of the preferred embodiments described in conjunction with the attached drawings.

BRIEF DESCRIPTION OF THE DRAWINGS

FIG. 1 is a table for use to evaluate suitability of a variety of elements whether or not the elements can be contained in a conductor layer of a thin-film thermal head;

DESCRIPTION OF THE PREFERRED EMBODIMENTS

Figure 2:
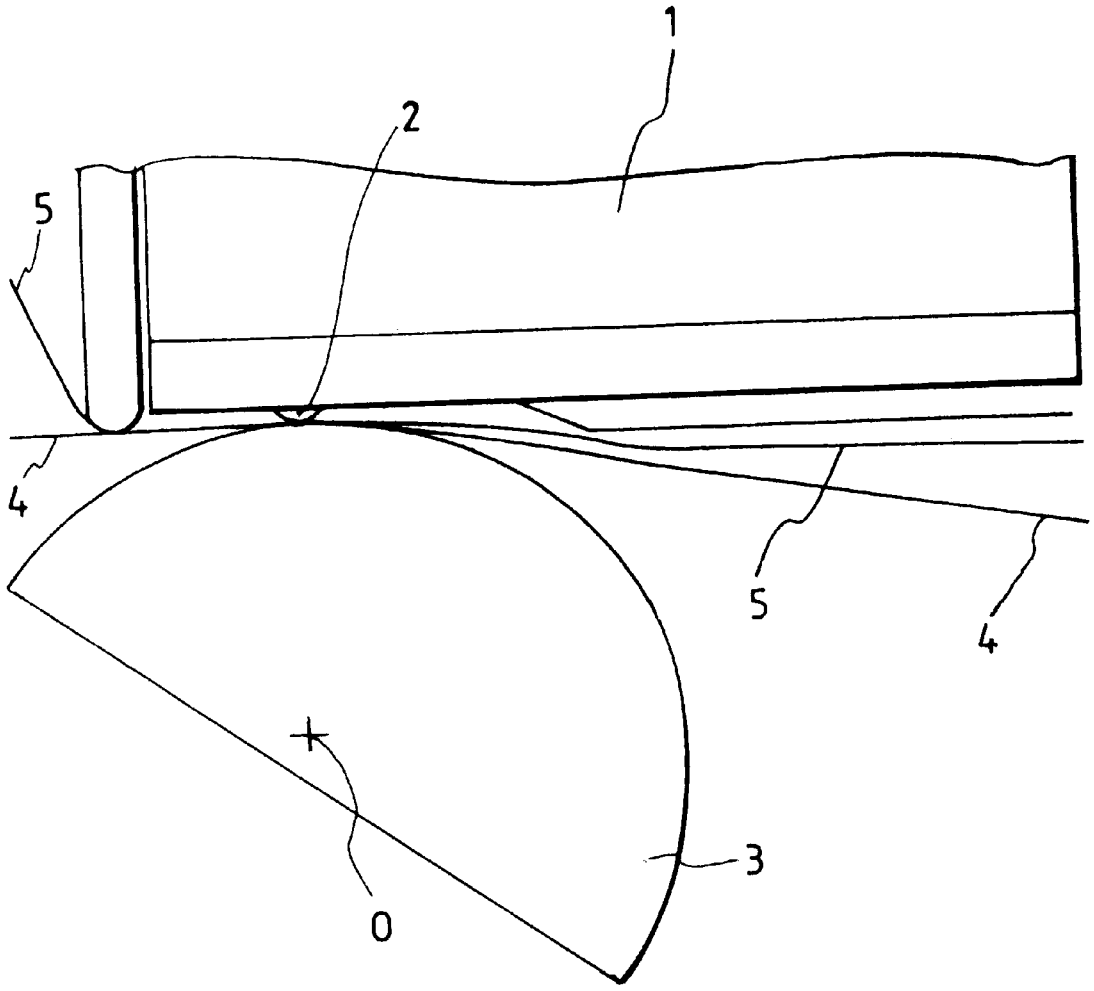
FIG. 2 is a schematic view showing the thin-film thermal head which is a subject of the conventional technique and the present invention.
Figure 3:
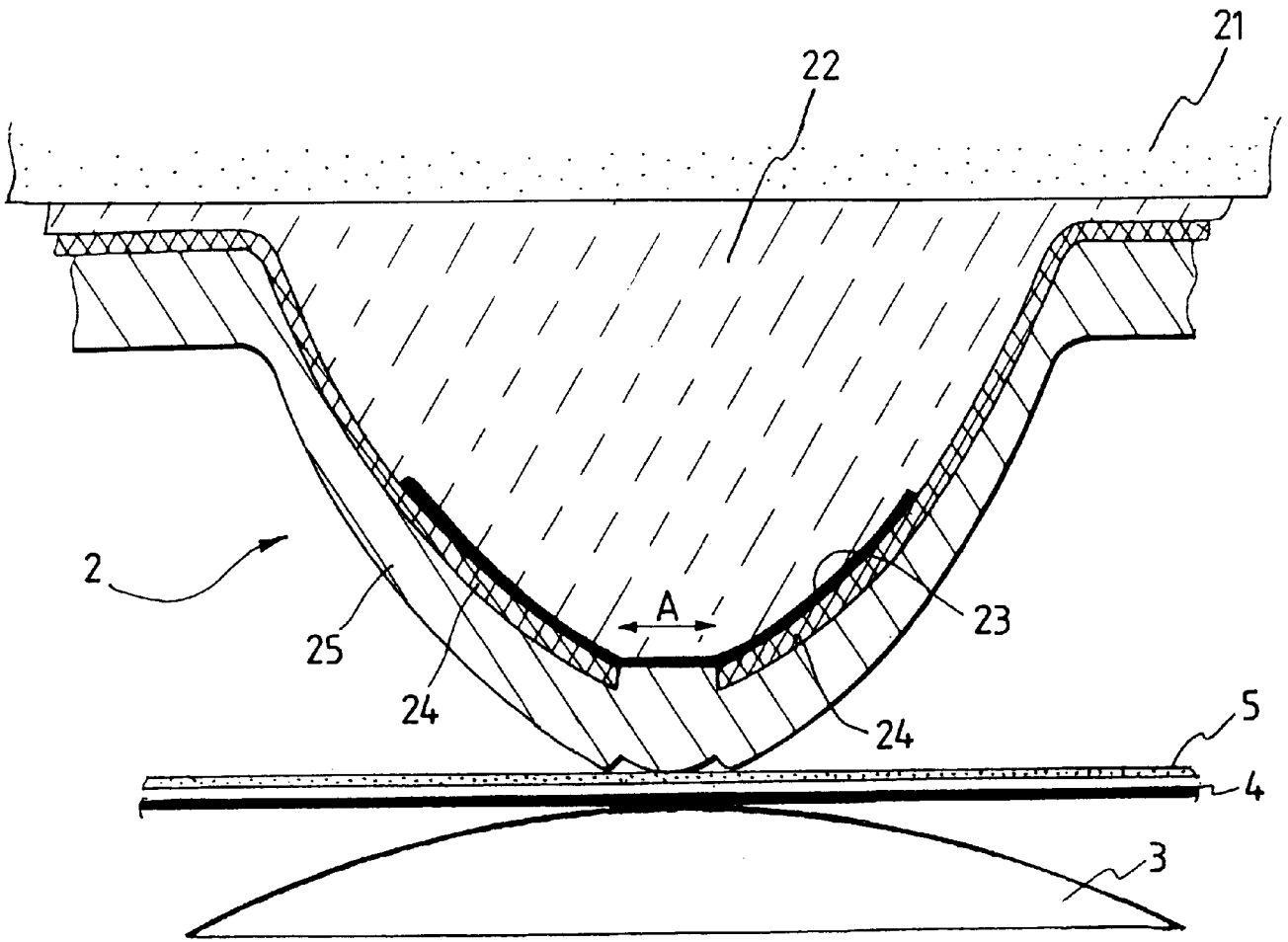
FIG. 3 is an enlarged cross sectional view showing a portion in the vicinity of the graze projection 2,shown in FIG. 2.

Embodiments of a thermal head according to the present invention will now be described with reference to the drawings.

FIG. 1 is a table which contains manufacturing yield ( %) of a variety of alloys variously containing elements Cu, Ag, Si, Ni and Al and resistance of each alloy (satisfactory or unsatisfactory) to evaluate suitability (suitable or unsuitable) of each alloy when the alloy is employed to be contained in a high-density thin-film thermal head.

EXAMPLES

(1) Example 1

(a) A conductor layer was constituted by an alloy containing Cu by 99.5 atom % (hereinafter a "atom" is omitted and atom % is abbreviated as "%") and Ag by 0.5%.

(b) The yield was 65% which was an excellent value and resulted resistance was satisfactory.

(c) Therefore, a result of the evaluation of the suitability for the high-density thin-film thermal head was satisfactory.

(2) Comparative Example 1

(a) A conductor layer contained only Cu by 100%.

(b) Although the resistance was satisfactory, the yield was 55% which was an unsatisfactory value. When the temperature was raised, Cu easily separated and, therefore, the yield deteriorated rapidly. Since the pitches of electrode conductors are reduced in a case of the high-density thin-film thermal head high-density, the width of each electric line is reduced. Hence it follows that the resistance and temperature are raised. Therefore, occurrence of easy separation at high temperatures raised a problem.

(3) Comparative Example 2

(a) A conductor layer contained only aluminum (Al) by 100%.

(b) Although the resistance was satisfactory, the yield was inferior to that of the conductor layer according to item (2) in which Cu was contained by 100%. The yield was 45%.

(c) Therefore, a result of the evaluation was unsatisfactory.

As described above, the conductor layers each containing only Cu by 100% or aluminum by 100% were unsatisfactory. A fact was confirmed that the separation of the film was prevented when Ag in a quantity of 0.5% or higher was added to Cu. As a result, lowering of the resistance and raising of the yield were simultaneously realized.

Examples 2 to 4 were arranged to evaluate structures in which Cu was decreased and Ag was increased.

(4) Example 2

(a) A conductor layer was constituted by an alloy containing Cu by 94.2% and Ag by 5.8%.

(b) The yield was 90% which was considerably higher than that realized in item (1). Also the resistance was satisfactory.

(c) Therefore, the result of the evaluation was satisfactory.

(5) Example 3

(a) A conductor layer was constituted by an alloy containing Cu by 88.7% and Ag by 11.3%.

(b) The yield was 90 % and the resistance was satisfactory.

(c) Therefore, the result of the evaluation was satisfactory.

(6) Example 4

(a) A conductor layer was constituted by an alloy containing Cu by 71.4% and Ag by 28.6%.

(b) The yield was 90% and the resistance was satisfactory.

(c) Therefore, the result of the evaluation was satisfactory.

When the ratio of Cu and Ag is reversed, a prediction is permitted that the yield was 90% or higher and also satisfactory resistance is realized. Since Ag is a costly element, the cost of the thin-film thermal head cannot be reduced. Therefore, a satisfactory advantage cannot be obtained from alloys of a type containing Ag by 50.0% or higher.

(7) Comparative Example 3

An element except for Ag was mixed with Cu. In this comparative example, silicon (Si) was selected.

(a) The conductor layer was constituted by an alloy containing Cu by 94.5% and Si by 5.5%.

(b) Although the yield was 90%, the resistance was unsatisfactory.

(c) Therefore, the evaluation of Comparative Example 3 was unsatisfactory.

As described above, a fact was confirmed that the Cu—Ag alloy was a suitable alloy. Moreover, metal except for Ag was not suitable. An alloy containing Cu by 50% or more and Ag by 50% or less was a satisfactory alloy from a viewpoint of practical use. As a result, lowering of the resistance and raising of the yield were simultaneously realized.

Examples 6 and 7 had a structure that another element was added in addition to Cu and Ag.

(8) Example 6

(a) A conductor layer was constituted by an alloy containing Cu by 90.5%, Ag by 9.3% and Si by 0.2%.

(b) The yield was 90% or higher and the resistance was satisfactory.

(c) Therefore, the result of the evaluation was satisfactory.

(9) Example 7

(a) A conductor layer was constituted by an alloy containing Cu by 87.8%, Ag by 10.3%, Si by 0.3% and Ni by 1.6%.

(b) The yield was 90% or higher and the resistance was satisfactory.

(c) Therefore, the result of the evaluation was satisfactory.

Therefore, when another element was contained in the alloy containing Cu by 50% or higher and Ag by 50% or lower, a satisfactory result was realized if the quantity of the other element was 0.2% or lower.

As described above, the conductor layer of the thin-film thermal head is structured such that the main component is Cu—Ag alloy so that the problems experienced with the conventional thin-film thermal head are overcome.

Therefore, the present invention is able to realize low resistance to permit the width of the electric line to be reduced. As a result, the pitches of the electric lines of the electrode conductor can be reduced. Hence it follows that a high-density thin-film thermal head having pitches of heating elements of 43 $\mu$m or smaller can be obtained.

A plurality of structures formed such that the conductor layer is constituted by the Cu—Ag alloy are known in another industrial field, for example, a thin-film magnetic heads (for example, refer to Japanese Patent Publication No. 2611867). However, a problem encountered with the foregoing thin-film magnetic head arises in that "when a Cu conductor layer is patterned into a coil form, asperities are formed on the surface of the Cu conductor during an ion milling operation. Thus, the foregoing asperities appear as asperities on the gap surface and, therefore, the electromagnetic conversion characteristic of the head deteriorates. Therefore, the foregoing technique is completely different from the present invention, the object of which is to prevent separation of a film which occurs when the conductor layer is constituted by only Cu.

A technique has been disclosed in Japanese Patent Publication No. 2611867 prior to the present invention and arranged to overcome the foregoing problem. However, no description and suggestion are made about a fact that the Cu—Ag alloy is able to effectively prevent separation of a film in a case of a conductor layer constituted by only Cu. Therefore, there is no inevitability in applying the technique disclosed in Japanese Patent Publication No. 2611867 to the industrial field of the high-density thin-film thermal head. Hence it follows that the present invention has novelty and advancement with respect to the technique disclosed in Japanese Patent Publication No. 2611867.

As described above, according to the present invention, there is provided the thin-film thermal head comprising a resistance heating layer and a conductor layer, wherein the main component of the conductor layer is a Cu—Ag alloy. In particular, the conductor layer contains Cu by 50 atom % or higher, Ag by 0.5 atom % or higher and 50 atom % or lower and other elements by 2 atom % or lower. Therefore, separation of a film can be prevented. As a result, lowering of the resistance and raising of the yield can simultaneously be realized.

Therefore, the resistance can be lowered and, therefore, the width of each electric line can be reduced. As a result, the pitches of the electric line of the electrode conductor can be reduced. Hence it follows that a high-density thin-film thermal head having the pitches of heating elements of 43 $\mu$m or shorter can be obtained.

Although the invention has been described in its preferred form and structure with a certain degree of particularity, it is understood that the present disclosure of the preferred form can be changed in the details of construction and in the combination and arrangement of parts without departing from the spirit and the scope of the invention as hereinafter claimed.

What is claimed is:

1. A thin-film thermal head comprising:

a resistance heating layer; and a conductor layer, wherein a main component of said conductor layer is a Cu—Ag alloy.

2. A thin-film thermal head according to claim 1, wherein said conductor layer contains Cu by 50 atom % or higher, Ag by 0.5 atom % or higher and 50 atom % or lower and other elements by 2 atom % or lower.

3. A thin-film thermal head according to any one of claims 1 or 2, wherein pitches of electric lines of the conductor layer are 43 $\mu$m or shorter.

* * * * *